United States Patent [19]

Rammler et al.

[11] Patent Number: 4,859,284

[45] Date of Patent: Aug. 22, 1989

[54] COMBINED PROCESS FOR THE SEPARATION AND CONTINUOUS COKING OF HIGH SOFTENING POINT ASPHALTENES

[75] Inventors: Roland Rammler, Konigstein; Hans-Jurgen Weiss, Frankfurt; Hans-Adolf Herbertz, Neu-Isenburg, all of Fed. Rep. of Germany; Rodolfo B. Solari, Los Teques; Rafael Hidalgo, Caracas, both of Venezuela

[73] Assignee: Intevep, S.A., Caracas, Venezuela

[21] Appl. No.: 906,892

[22] Filed: Sep. 15, 1986

[30] Foreign Application Priority Data

Mar. 25, 1986 [DE] Fed. Rep. of Germany ..... 3609988

[51] Int. Cl.[4] ..... C10B 55/06; C10C 3/08

[52] U.S. Cl. ..... 201/12; 201/25; 201/28; 201/33; 208/45; 208/309

[58] Field of Search ..... 201/22, 23, 28, 33, 201/12, 25; 208/39, 45, 50, 44, 86, 126, 176, 309

[56] References Cited

U.S. PATENT DOCUMENTS

| | | | |
|---|---|---|---|
| 4,054,492 | 10/1977 | Rammler et al. | 201/22 |
| 4,101,415 | 7/1978 | Crowley | 208/45 |
| 4,572,718 | 2/1986 | Krasuk et al. | 208/45 |

*Primary Examiner*—Joye Woodard

*Attorney, Agent, or Firm*—Bachman & LaPointe

[57] ABSTRACT

The present invention relates to a combined process for separating and converting asphaltenes of high molecular weight and high softening point from heavy hydrocarbon material containing asphaltenes by a process that combines a deasphalting method to produce solid asphaltenes and a continuous coking procedure for the solid asphaltenes. The combined process converts the material into more valuable liquid hydrocarbon products of lower molecular weight and coke.

5 Claims, 1 Drawing Sheet

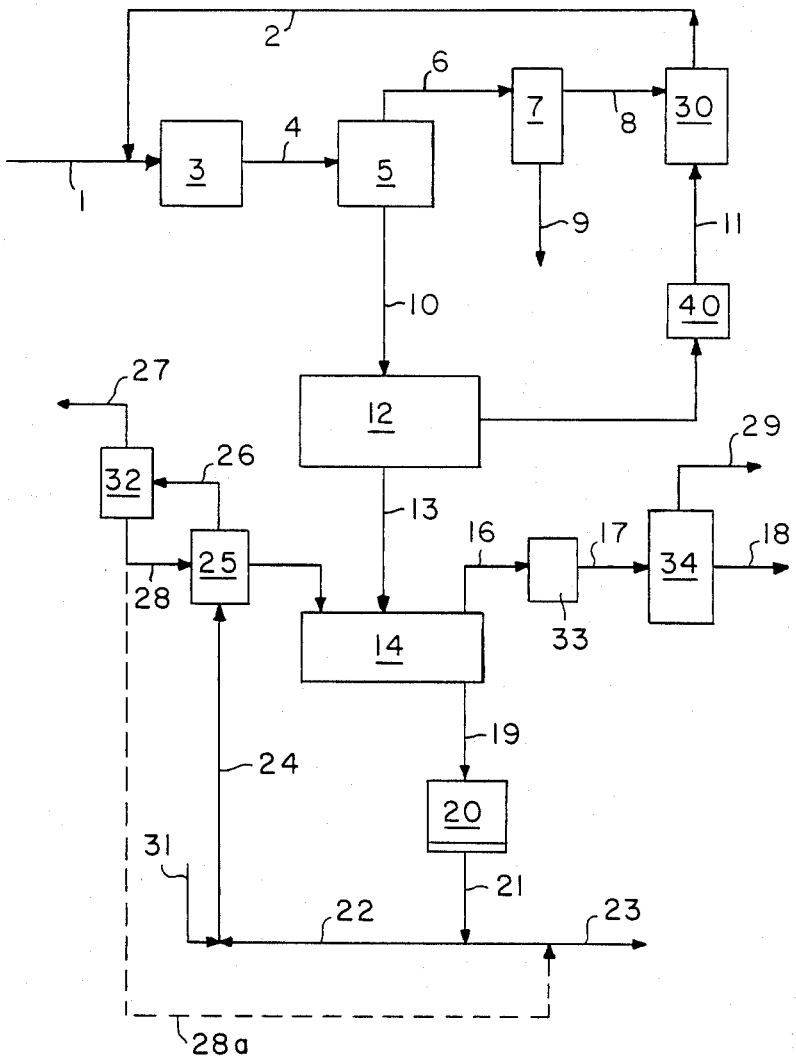
2
6
7
30
8
4
3
5
1
9
11
10
40
27
12
29
32
26
13
16
17
34
18
25
28
33
14
19
24
20
31
21
22
23
28a

COMBINED PROCESS FOR THE SEPARATION AND CONTINUOUS COKING OF HIGH SOFTENING POINT ASPHALTENES

BACKGROUND OF THE INVENTION

The present invention relates to a combined process for separating and converting asphaltenes of high molecular weight and high softening point from heavy hydrocarbon material containing asphaltenes by a process that combines a deasphalting method to produce solid asphaltenes and a continuous coking procedure for said solid asphaltenes. The combined process converts said material into more valuable liquid hydrocarbon products of lower molecular weight and coke.

Heavy crude oils have high asphaltene content which is detrimental to further processing of these crude oils to convert them into more valuable products.

In distilling these heavy oils, it is only possible to recover about 40 to 60 weight percent of distillate and heavy gas oil, still leaving a large fraction of heavy residue with high concentration of asphaltenes, metals and sulfur. By means of solvent deasphalting using an aliphatic hydrocarbon with 5 to 12 carbon atoms in its molecule, it is possible to make a deeper cut and extract more oil and resins, thus increasing the recovery of oil products almost free of asphaltenes and having a lower metal content, which can be used as a feed to downstream refining processes, such as fluid catalytic cracking, catalyic desulfurization or the like. The metals are mainly concentrated in the precipitated asphaltenes of high softening point and high molecular weight.

In recent years, solvent deasphalting has evolved in the direction of increasing deasphalted oil yields using heavy paraffinic solvents like pentane, hexane or light naphthas. This reduces production of asphaltenes leaving a very hard material with softening point over 170° C. and molecular weight over 1500. These asphaltenes have low commercial value due to high metal and sulfur content, therefore it is commercially attractive to convert them into more valuable products, increasing the amount of distillate obtained from the heavy crude oil and reducing the pilestock of low value asphaltenes.

Asphaltenes are thermal labile products that decompose when they are heated. Therefore, asphaltenes can be heated up to cracking temperature to produce distillate, gas and coke. This heating process is a coking process because the feed product is cracked to produce coke.

There are no commercial processes for asphaltene coking. Other coking technologies that could be potentially applied to low softening point asphaltenes like delayed coking require a liquid feedstock. These types of processes have severe limitations when used with high softening point asphaltenes, since these asphaltenes will start decomposing before they are melted. High softening point asphaltene decomposition usually begins at 180° C. while they melt close to 300° C. This puts limitation in the feeding system for any conventional coking technology, rendering it almost impossible to feed the asphaltenes to the coking unit. Therefore, application of conventional systems have been limited to asphalt containing streams coming from the bottom of vacuum residue towers in petroleum refineries.

SUMMARY OF THE INVENTION

Accordingly, this invention provides a process for the production and the continuous coking of high softening point asphaltenes from heavy hydrocarbon material, that combines a deasphalting method to produce solid asphaltenes with a continuous coking procedure for said solid asphaltenes, comprising the following steps:

(a) admixing said heavy hydrocarbon material containing asphaltenes with an aliphatic hydrocarbon solvent with five to twelve carbon atoms in a mixing zone to precipitate the asphaltenes in form of fine solid particles, (b) mechanically separating the solid asphaltene particles from the mixture by means of hydrocyclones and/or centrifugal decanters to obtain a highly concentrated asphaltene slurry and a liquid phase, (c) feeding said liquid phase into an evaporation zone and separating vaporous solvent from deasphalted oil and subsequently condensing said vaporous solvent, (d) drying the asphaltene slurry from (b) in a spray dryer to obtain completely dried asphaltenes of high softening point in form of a fine powder and vaporous solvent to be subsequently condensed, (e) mixing the dried asphaltenes from (d) together with a hot stream of petrol coke in a double screw coking mixer to obtain gaseous coker products and petrol coke and withdrawing said gaseous products, (f) feeding the petrol coke from (e) into a surge bin, (g) cooling and condensing the withdrawn gaseous coker products to obtain coker distillate products, (h) partially burning the petrol coke from said surge bin in a lift pipe while it is pneumatically lifted using air, (i) separating the hot petrol coke from the flue gas in a heat carrier bin, and (j) recycling at least a portion of the hot petrol coke from said heat carrier bin to said coking mixer.

The combined use of a solvent deasphalting process that handles asphaltenes in a solid phase all throughout the process, with a continuous coking system having a double screw mixing reactor is a completely new invention that solves long-recognized problems in coking heat labile asphaltenes that cannot be heated or melted without becoming sticky or decomposing. The novelty of this process combination permits surprisingly high yield of valuable hydrocarbon distillates from low value asphaltenes, leaving only a reduced amount of petrol coke to be burned out.

BRIEF DESCRIPTION OF THE DRAWINGS

The sole FIGURE is a schematic illustrating the process steps of the present invention.

DETAILED DESCRIPTION

A feedstock including a heavy hydrocarbon material is introduced into a mixing zone 3 through line 1. The heavy hydrocarbon material can be any heavy crude oil, or an atmospheric or vacuum residue that has been submitted to a thermal conversion process such as visbreaking or hydrovisbreaking.

A solvent stream from a storage tank 30 is introduced via line 2 into mixing zone 3 to be contacted and admixed with the feedstock to provide a mixture. The solvent is a mixture of aliphatic hydrocarbons having 5–12 carbon atoms in the molecule, such as pentane, hexane, heptane or a light naphtha with a boiling range within 80° C. to 160° C. Sufficient solvent is introduced into mixing zone 3 to provide a feed to solvent volume ratio in the range from about 1:2 to 1:12, and preferably in the range of about 1:2 to 1:6. By the solvent, solid asphaltenes are precipitated in the mixture. Temperature, pressure and residence time in the mixing zone 3 are in the ranges of 70° to 160° C., 1 to 200 psig, and 0.5 to 5 minutes respectively. These operation conditions are more precisely described in U.S. Pat. No. 4,572,781.

The mixture of solvent, solid asphaltene particles and oil dissolved in the solvent is withdrawn from mixing zone 3 and introduced into a mechanical separator 5 via line 4. This mechanical separator can be a hydrocyclone of small diameter and/or a centrifugal decanter. The mechanical separator or separators separate the small and fine particles of solid asphaltenes at near atmospheric pressure and a temperature below 45° C. Operating conditions are preferably controlled so that the asphaltene content (measured as heptane asphaltene) in the liquid overflow through line 6 is less than 1 to 0.5 percent by weight based on the weight of the deasphalted oil after removal of the solvent in evaporator 7. Evaporator 7 is a conventional system that comprises an evaporator and a stripper that operates above the boiling temperature of the solvent and a pressure level at least equal to the actual vapor pressure of the solvent at its highest temperature.

The yield of deasphalted oil free from solvent obtained through line 9 is in the range of about 75 to 90% and preferably in the range of 82 to 86% by weight over the total feedstock fed through line 1 in the case that heavy and extraheavy oil are used as feedstock. If the feedstock is a refinery residue deasphalted oil yields can be in a range between 60 and 80% weight. Solvent vapor from evaporator 7 is condensed (not shown) and fed as a liquid through line 8 into storage tank 30.

The solid asphaltenes impregnated with solvent leave the mechanical separator 5 through line 10 having an asphaltene concentration of about 40 to 60% by weight and enter spray dryer 12. In this dryer the asphaltenes are dispersed in very fine solid particles which dry quickly at a temperature of at least 50° C. below the softening point of the asphaltenes typically in the range of about 100° to 180° C., and preferably in the range of about 140° to 160° C. of drying temperature. In dryer 12 the solvent is evaporated by adding heat from a hot inert gas, transferred through line 11 to the condenser 40 and fed as a liquid to solvent storage tank 30. In the dryer the solid asphaltenes become very hard solid particles which are not sticky at that temperature level. These asphaltenes completely free from solvent and with a softening point not lower than 170° C. are discharged from dryer 12 through line 13 and are conveyed in a screw feeder at about ambient temperature to the double screw mixer 14, which is the coking reactor.

Simultaneously a solid heat carrier consisting of petrol coke is fed to the double screw mixer 14 through line 15. Said heat carrier consists of fine coke particles of 0.2 to 2 mm diameter having a temperature of 500° to 800° C. and provides the heat required to crack the asphaltenes. In mixer 14, the asphaltenes are intimately mixed with the hot coke and thermally cracked. Typical operating conditions in the mixer are temperatures in the range of 500° to 600° C., preferably of about 500° to 520° C. Mixing ratio between feed and heat carrier is in the range of about 1:5 to 1:40 and preferably 1:10 to 1:30. Inside the mixer 14 thermal cracking reactions take place transforming the solid asphaltenes in gaseous and vaporous hydrocarbon products of lower molecular weight and coke that is used as a heat carrier. The mixer 14, which is described in German Patent 12 52 623 and corresponding U.S. Pat. No. 3,308,219, has two integral selfcleaning screws, which allow simultaneous mixing of the heat carrier with the asphaltenes and transportation of the mixture while the thermal cracking reaction is occurring.

The petrol coke produced in mixer 14 is discharged through line 19 to surge bin 20, to be evacuated by gravity through line 21. Part of the petrol coke is sent to cooling and storage through line 23 and the remaining fraction through line 22 is lifted with hot air from line 31 through the lift pipe 24, where the petrol coke is partially burned to meet the heat demand of the coking process. Temperature in the lift pipe is within the range of 500° to 800° C., preferably about 600° to 700° C. Lift pipe 24 discharges into the heat carrier bin 25. The hot petrol coke deposited in bin 25 is at least in part recycled to the coking mixer 14 through line 15. The flue gas resulting from the partial combustion of the petrol coke leaves the heat carrier bin 25 through line 26 to the flue gas dedusting system 32 to obtain a clean flue gas to be exhausted through line 27 and to collect the finest particles of the petrol coke entrained with the flue gas, which are recycled to the heat carrier bin 25 through line 28 or alternatively discharged to the coke cooling and storage means through lines **28*a* and 23**.

The gaseous hydrocarbon product leaves the mixer 14 through line 16 and is fed, if necessary, to a cyclone 33, where fine solid particles are eliminated from the hydrocarbon vapours. These vapours are fed through line 17 to a condenser system 34 to obtain through line 18 coker distillates consisting of a liquid hydrocarbon mixture mainly boiling within the range of 100° to 560° C. From the condenser system 34 also a stream of clean coker gas is discharged through line 29.

Having thus described in broader terms embodiments of the present invention, the following more detailed description is provided with reference to a specific example. However, the following example is not to be construed as limiting the scope of the invention.

EXAMPLE

This example is described with reference to the drawing. The feed used in this example is a Venezuelan heavy crude oil with the properties given in table 1, column "feed".

100 kg/hr of this feed with 12% by weight of hexane insoluble asphaltenes is admixed in mixer 3 with 400 kg/hr of hexane from line 2 as solvent. The mixer 3 is a static on line mixer consisting of a tube with an internal screw that operates at temperatures below 150° C. The resultant mixture containing 2.4% by weight of precipitated asphaltenes, 17.6% wt of dissolved deasphalted oil and 80% wt of hexane is cooled to 40° C. before being introduced into a centrifugal decanter 5 of 0.23 m inside diameter. After separation has been completed, 474 kg/hr of clear solution leaves the mechanical separator 5 through line 6 containing 0.10% wt of asphaltenes, 17.83% wt of deasphalted oil and 82.87% wt of hexane. After solvent removal in the evaporator 7, consisting of a conventional shell and tube heater and a stripper column, a total of 389 kg/hr of hexane is recovered and sent to the solvent storage tank 30 through line 8. The deasphalted oil free of solvent obtained through line 9 amounts to 85 kg/hr, containing only 0.59% by weight of asphaltenes. Therefore, total yield of deasphalted oil over total feed is 85% wt and its quality is given in table 1 in column "deasphalted oil".

From the bottom of the centrifugal separator 5, a total of 26 kg/hr of concentrated asphaltene slurry is discharged through line 10 having 44.2% wt of asphaltenes, 13.5% wt of deasphalted oil and 42.3% wt of hexane. This slurry is introduced to the spray dryer 12 that operates at 160° C. to recover 11 kg/hr of hexane through line 11 that is recycled to the solvent storage tank 30. A total of 15 kg/hr of completely dry asphaltenes is obtained from the dryer through line 13. The quality of these alphatenes is shown in table 1, last column. It can be seen that yield of asphaltenes is only 15% by weight over total crude fed to the plant and their softening point is 220° C. The asphaltenes contain only 23% by weight of material soluble in hexane.

Dry asphaltenes are introduced to the mixer 14 through line 13. From heat carrier bin 25, a solid stream of 300 kg/hr of petrol coke at 650° C. is transferred through line 15 to the mixer 14 to be mixed with and heating the asphaltenes. A total gas flowrate of 9.2 kg/hr is obtained from the mixer leaving through line 16. This gas stream goes through the condenser system 34 to separate 0.9 kg/hr of non-condensable coker gas through line 29 and 8.3 kg/hr of coker distillate discharged to storage through line 18. Composition and main properties of the coker gas and coker distillate are given in tables 2 and 3, respectively. Adding streams 9 and 18, corresponding to deasphalted oil and coker distillate respectively, a total of 93.3 kg/hr of liquid product is obtained from the combined process. Therefore, total yield of liquid products is 93.3% over the crude oil fed to the combined process.

In this example a double screw mixer, known per se, was used. Operating conditions were 1 atmosphere and 620° C. A solid stream of 305.8 kg/hr of petrol coke was discharged from the coking mixer 14 through line 19 to the surge bin 20. Petrol coke from the surge bin is partially discharged through line 23 to storage. The amount discharged is 5.1 kg/hr of petrol coke with the properties given in table 4.

Line 22 carries 300.7 kg/hr of petrol coke to be partially burned in the lift pipe at a temperature of 650° C. with 7.3 kg/hr of preheated air coming through line 31. In the heat carrier bin 25 are separated: 300 kg/hr of petrol coke that leave through line 15 at a temperature of 650° C., and the flue gases that are discharged through line 26 to the flue gas separator system 32. From here, 8 kg/hr of flue gas are discharged to vent.

TABLE 1

| properties | feed | deasphalted oil | asphaltenes |
|---|---|---|---|
| API gravity | 12.2 | 14.8 | −8.5 |
| specific gravity at 15.6° C. | 0.9847 | 0.9672 | 1.15 |
| sulphur % wt | 3.0 | 2.8 | 4.3 |
| nitrogen % wt | 0.54 | 0.4 | 1.37 |
| Conradson carbon % wt | 10.8 | 6.3 | 36.40 |
| $C_7$ asphaltenes % wt | 8.2 | 0.9 | — |
| vanadium wt ppm | 339 | 155 | 1380 |
| nickel wt ppm | 80 | 39 | 316 |
| viscosity: | | | |
| cSt at 60° C. | 630 | 150 | — |
| cSt at 100° C. | 72 | 31 | — |
| softening point °C. | — | — | 220 |
| dropping point °C. | — | — | 270 |

TABLE 2

| Coker Gas Composition | |
|---|---|
| component | percent by volume |
| CO | 1.9 |
| $CO_2$ | 2.4 |
| $H_2$ | 8.7 |

TABLE 2-continued

| Coker Gas Composition | |
|---|---|
| component | percent by volume |
| $CH_4$ | 37.2 |
| $C_2H_6$ | 11.2 |
| $C_2H_4$ | 6.7 |
| $C_3H_8$ | 4.8 |
| $C_3H_6$ | 5.6 |
| $C_4H_{10}$ | 2.3 |
| $C_4H_8$ | 4.1 |
| $H_2S$ | 15.1 |
| gas density kg/m$^3$ | 1.187 |
| combustion value MJ/m$^3$ | 54.9 |

TABLE 3

| Coker Distillates Composition | |
|---|---|
| properties | |
| density at 15° C. | 957.1 kg/m$^3$ |
| Conradson carbon | 6.8% wt |
| bromine number | 31.5 g/100 g |
| molecular weight | 274 |
| vanadium content | 38 wt ppm |
| nickel content | 7 wt ppm |
| vacuum residue | 24.3% wt |
| ultimate analysis % weight | |
| carbon | 83 |
| hydrogen | 10.79 |
| nitrogen | 0.57 |
| sulfur | 2.92 |
| oxygen | 2.68 |
| boiling analysis | |
| percent by volume | temperature °C. |
| IBP | 90 |
| 5 | 165 |
| 10 | 215 |
| 20 | 255 |
| 30 | 297 |
| 40 | 331 |
| 50 | 372 |
| 60 | 414 |
| 80 | 459 |

TABLE 4

| Petrol Coke Composition (ash free) | |
|---|---|
| component | percent by weight |
| carbon | 85.80 |
| hydrogen | 2.45 |
| nitrogen | 3.09 |
| sulfur | 4.62 |
| oxygen | 3.55 |
| vanadium | 0.38 |
| nickel | 0.09 |

We claim:

1. A process for the separation and the continuous coking of high softening point asphaltenes from heavy hydrocarbon material containing asphaltenes, that combines a deasphalting method to separate solid asphaltenes with a continuous coking process for said solid asphaltenes, comprising the following steps:

(a) admixing said heavy hydrocarbon material containing asphaltenes with an aliphatic $C_5$ to $C_{12}$ hydrocarbon solvent in a mixing zone to precipitate the asphaltenes in the form of fine solid particles, (b) mechanically separating the solid asphaltene particles from the mixture to obtain a highly concentrated asphaltene slurry and a liquid phase, (c) drying the asphaltene slurry to obtain completely dried high softening point asphaltenes in the form of a fine powder wherein the asphaltene softening point is not lower than 170° C., (d) feeding the dried high softening point asphaltenes to a double screw coking mixer, (e) mixing said asphaltenes in said double screw coking mixer with a heat carrier to obtain gaseous coker products and a petrol coke reaction product, (f) feeding the petrol coke reaction product to a surge bin, (g) partially burning the petrol coke, and (h) thereafter recycling at least a portion of the hot petrol coke reaction product from said surge bin to said coking mixer together with said high softening point asphaltenes wherein the mixing ratio between said high softening point asphaltenes and said petrol coke reaction product is in the range of about 1:5 to 1:40 so as to form a substantially pure hydrocarbon feed to said coking mixer wherein said petrol coke reaction product acts as said heat carrier.

2. A combined process according to claim 1, wherein the heavy hydrocarbon material can be any heavy crude oil, or an atmospheric or vacuum residue or hydrocarbon residues that have been submitted to a thermal conversion process by visbreaking or hydrovisbreaking.

3. A combined process according to claim 1 wherein the petrol coke is burned in a lift pipe while it is pneumatically lifted using air.

4. A combined process according to claim 3 including separating the hot petrol coke from the flue gases in the surge bin.

5. A combined process according to claim 1 wherein the mixing ratio between said high softening point asphaltenes and said petrol coke reaction product is in the range of about 1:10 to 1:30.

* * * * *

UNITED STATES PATENT AND TRADEMARK OFFICE

CERTIFICATE OF CORRECTION

PATENT NO. : 4,859,284

DATED : August 22, 1989

INVENTOR(S) : ROLAND RAMMLER ET AL.

It is certified that error appears in the above-identified patent and that said Letters Patent is hereby corrected as shown below:

On the Cover Page, under the heading "Assignee:", insert --METALLGESELLSCHAFT A.G., Federal Republic of Germany, after "INTEVEP, S.A., Caracas, Venezuela".

Signed and Sealed this

Eleventh Day of June, 1991

*Attest:*

*Attesting Officer*

HARRY F. MANBECK, JR.

*Commissioner of Patents and Trademarks*